US010201890B1

(12) United States Patent
Koljaka

(10) Patent No.: US 10,201,890 B1
(45) Date of Patent: Feb. 12, 2019

(54) SINTERED METAL CARBIDE CONTAINING DIAMOND PARTICLES AND INDUCTION HEATING METHOD OF MAKING SAME

(71) Applicant: TKW, LLC, Louisville, KY (US)

(72) Inventor: Franc Koljaka, Louisville, KY (US)

(73) Assignee: TKW, LLC, Louisville, KY (US)

( * ) Notice: Subject to any disclaimer, the term of this patent is extended or adjusted under 35 U.S.C. 154(b) by 250 days.

(21) Appl. No.: 14/642,105

(22) Filed: Mar. 9, 2015

Related U.S. Application Data

(60) Provisional application No. 61/967,041, filed on Mar. 10, 2014.

(51) Int. Cl.
*B24D 3/06* (2006.01)
*B24D 18/00* (2006.01)

(52) U.S. Cl.
CPC ..... *B24D 3/06* (2013.01); *B24D 18/00* (2013.01)

(58) Field of Classification Search
CPC ..... B24D 18/0009; B24D 18/0054; B33Y 10/00; B33Y 70/00; B33Y 80/00; E21B 10/56; E21B 10/567
See application file for complete search history.

(56) References Cited

U.S. PATENT DOCUMENTS 3,594,141 A * 7/1971 Houstan et al. ..... B24D 3/10 51/295
3,708,645 A 1/1973 Osborn
3,879,901 A 4/1975 Caveney
3,940,050 A 2/1976 Johnson et al.
4,097,274 A * 6/1978 Bakul ..... B01J 3/062 419/11
4,961,780 A 10/1990 Pennington, Jr.
6,749,653 B2 6/2004 Castro et al.
2009/0301788 A1 12/2009 Stevens et al.
(Continued)

FOREIGN PATENT DOCUMENTS

GB 1483638 8/1977

OTHER PUBLICATIONS

Zhang et al. "effect of titanium coating on property of diamond"; Trans.Nonferrous Met.Soc.China 17(2007) 715-719.*
(Continued)

*Primary Examiner* — Shuangyi Abu Ali
(74) *Attorney, Agent, or Firm* — Middleton Reutlinger; James R. Higgins; Megan E. Gibson

(57) ABSTRACT

A method to produce a sintered metal carbide article containing diamond particles throughout said article is disclosed. In one embodiment, the method involves creating a mixture of metal carbide (MC) particles, metallic binder (MB) particles and coated diamond (D) particles is compacted into a desired shape and then heated at a temperature below the graphitization temperature of the D particles to produce an under sintered MC-MB-D article which is then rapidly heated in an induction heating device to surprisingly produce a sintered MC-MB-D article containing diamond particles throughout the article. The MC-MB-D article exhibits excellent drilling/cutting capacity and surprisingly high impact resistance. One useful MC-B-D article made according to the disclosed invention is a tungsten carbide-cobalt (WC—Co) article containing diamonds WC—Co-D throughout the article.

14 Claims, 6 Drawing Sheets

(56) References Cited

U.S. PATENT DOCUMENTS

| | | | | |
|---|---|---|---|---|
| 2011/0212825 | A1* | 9/2011 | Konyashin | C22C 26/00 501/93 |
| 2013/0168159 | A1 | 7/2013 | Eyre et al. | |
| 2014/0298728 | A1* | 10/2014 | Keshavan | E21B 10/56 51/298 |

OTHER PUBLICATIONS

Elsevier, Rapid Sintering of Nano-Diamond Compacts, magazine, Jan. 31, 2009, Diamond & Related Materials vol. 18, pp. 1061-1064.

* cited by examiner

SINTERED METAL CARBIDE CONTAINING DIAMOND PARTICLES AND INDUCTION HEATING METHOD OF MAKING SAME

CROSS-REFERENCE TO RELATED APPLICATION(S)

This application claims the benefit of U.S. Provisional Patent Application Ser. No. 61/967,041 filed Mar. 10, 2014 and entitled "Manufacturing Process of Diamond Cemented Carbide Composite Inserts".

FIELD OF THE INVENTION

The present invention relates generally to a method for manufacturing sintered metal carbide articles containing diamond particles throughout, and the articles made according to such method. The articles made according to the process(es) set forth herein are used primarily for inserts on cutting or drilling tools.

DESCRIPTION OF THE RELATED ART

Cemented, or sintered, metal carbide inserts are used in a very wide range of applications, such as cutting, drilling, machining and other mechanical operations of different materials such as wood, metal, masonry, rock and many others. Cemented carbides are composite materials that consist generally of carbide particles held together by a metal matrix. The most widely used and well known cemented carbide is composed of tungsten carbide (WC) particles embedded in a cobalt (Co) or nickel (Ni) matrix. Other metal carbides include titanium carbide (TiC), chromium carbide (CrC), vanadium carbide (VaC), niobium carbide (NbC) and tantalum carbide (TaC).

One form of metal carbide, tungsten carbide (WC), is one of the hardest known materials and its function is to perform the operations of cutting or drilling into the material. The metal binder, usually cobalt (Co) or Nickel (Ni) or other metallic binder, is a soft metal whose purpose is to hold together the WC particles and confer a better impact resistance to the composite. Depending on the application and material to be machined, other alloys may be added to the composition as understood by persons skilled in the art. Likewise, persons skilled in the metal carbide arts appreciate that the proportions of the different materials and their grain sizes can vary in a wide range and are important in determining the properties of the final composite materials.

The most widely used and known manufacturing process of cemented carbide is by initially mixing the different powders of metal carbide, metal binder (matrix) and possibly additional alloys. Organic binders (paraffin, bees wax, polymeric resin, etc.) may be added to the mixture in order to improve the subsequent compacting processes. This powder mixture is compacted further by pressing, pre-forming or injection molding in a special tool that contains a cavity in the shape of the final product. In order to ensure a better compaction of this so-called "green" part, organic binders such as paraffin, bees wax or other polymers may be added to the powder mixture in small quantities.

Compacted parts are then inserted in a high temperature furnace under protective atmosphere or vacuum (to prevent oxidation, and the like) to undergo the process of sintering. In the first phase of the heating process, wax evaporates from the "green parts" starting at around 200° C. It is important during this phase to have a slow heating rate in order to ensure that the parts are not disintegrated from the escaping vapors. The de-wax process step will produce a dry part or article made of carbide and binder particles generally called "brown part". In the pre-forming process brown parts are produced in "brick" form, and the brown "brick" is machined to final shape and then sintered to final form. At higher temperatures, metal carbide (such as WC) dissolves partially in the metal (matrix) binder (such as cobalt (Co) or nickel (Ni)), and creates a eutectic phase with a melting temperature significantly lower than the metal matrix. For instance, as known by persons skilled in the art, while the melting temperature of pure cobalt is 1495° C., the Co—WC eutectic has a melting temperature of 1275° C. (see FIG. 1, the W—Co—C phase diagram, well-known by those skilled in the art).

The partially molten metal carbide-metal binder solution fills the voids around the carbide particles left open by the wax binder and/or by the compacting operation by the well-understood process of sintering. Different compositions have differing sintering characteristics. Persons skilled in the art appreciate that the term "sintered" embraces the entire heating cycle, from initial heating to remove the organic binder in a non-destructive manner, then heating to the target temperature also in a manner that does not damage the part(s), then holding at a target temperature above the eutectic temperature occurs to achieve desired sintering, then cooling in a manner that does not damage the part(s). After the liquid phase has filled all voids and the part has become compact, the cooling phase during which a precipitation of the carbide back into the matrix occurs. In order to achieve desired compaction and eliminate all the porosity (especially in the case of larger size products), high pressure inert gas may be inserted into the furnace during the process known as HIP (hot isostatic pressing).

It is appreciated by persons skilled in the art that diamond, which of course is crystalline carbon (C), is one of the hardest materials used in material science applications. Carbide manufacturers and researchers have long tried to include diamond particles in the cemented carbide parts because of the high hardness and excellent wear resistance of diamond. If so included, cemented carbide parts containing diamond particles would present many advantages for the cutting and drilling industry:

- cutting/drilling tools will have a longer lifetime since new sharp diamond particles will emerge every time a layer of material has been worn out;
- the cemented carbide matrix is much tougher than solid diamond making possible the utilization of these tools in impact application;
- the benefit/cost ratio will be more favorable than for both cemented carbide and solid diamond components.

There are two main reasons why the industry has struggled and thus far largely failed to come up with a commercial manufacturing processes to successfully incorporate diamond particles in cemented carbide and materials used in the cemented carbide industry are not appropriate for the sintering of diamond crystals:

- Diamond converts to graphite at temperatures below the sintering temperature.
- Diamond may be dissolved into the metal binder at sintering temperatures.

Graphitization—

All chemical and metallurgical processes need time to fully develop even if all other conditions have been fulfilled. For this reason, the efforts to avoid the graphitization of diamond particles have been focused in developing very fast processes at high temperatures. The temperature where diamond starts converting to graphite may be as low as 1300° C. In any case, at the temperature range above 1275° C. where the sintering process takes place (in case of a Co binder), diamond can graphitize due to the long times involved in both protective atmosphere and vacuum furnaces. For this reason, sintering processes for diamond containing inserts involve very short time processes at sintering temperatures in order to avoid the transformation of the diamond particles into graphite while assuring a perfect bonding between them and the metal matrix. A widely used technique for this purpose is hot pressing, followed by spark plasma sintering, and, rarely, microwave sintering. These processes involve expensive equipment which are capable of only a limited output, less than production quantities.

Dissolution—

Cobalt and nickel, the most widely used metallic binders, have a high affinity for carbon and start dissolving it at relatively low temperatures (see FIG. 2, the Co—C phase diagram, also well-known in the art). At the sintering temperature range, this process is extremely fast and can happen in a very short time, even during the fast heating techniques as those described in the above paragraph. Various attempts have been made to use different binders that do not dissolve the diamond carbon and yet ensure a good binding of the particles of tungsten carbide and the diamond itself. For instance, some encouraging results have been obtained by using various intermetallic materials such as nickel aluminide ($Ni_3Al$).

Oxidation—

In addition to the above two problems, persons skilled in the art appreciate that the sintering process of the cemented carbide parts is performed in a controlled, non-oxidizing atmosphere (neutral or reductive) or in vacuum furnaces since such products are at oxidation risk, also, if in contact with the oxygen of the atmosphere. For this reason, processes and equipment for the sintering of cemented carbides may be appropriate for metal carbide parts containing diamond particles.

A different albeit expensive process that has been adopted and has experienced some commercial acceptance is the production of polycrystalline diamond (PCD) tipped carbide inserts. This material is made by sintering diamond crystals at high temperatures and pressures in the presence of a liquid metal. Often, PCD inserts are bonded to a tungsten carbide base during the same high-temperature, high-pressure process. This sintered diamond and tungsten carbide composite product is known in the oil and gas drilling industry as a Polycrystalline Diamond Compact (PDC) cutter. PDCs have an excellent wear resistance due to the presence of diamond crystals, but their use in impact applications is very limited, if not nonexistent, because of the brittleness of the sintered diamond insert. Furthermore, the cost of PDCs is several factors higher than cemented carbide inserts due to more expensive materials and manufacturing processes.

Other processes use resin or ductile metal binders with low melting temperatures in order to achieve compaction and strength, but these products are generally used in grinding applications and do not possess the properties and characteristics required for drilling or cutting hard materials. There have been attempts to use alternative binders for diamond sintering with different degrees of success, but they have not yet found a practical use in the industry.

Accordingly, there is a long felt need in the art for a commercial process that can incorporate diamond particles in a cemented metal carbide article. That need is satisfied by one or more embodiments of the invention(s) described and claimed herein.

Other features, objects and advantages of the present invention will become apparent from the following detailed description taken in conjunction with the appended drawing Figures.

BRIEF DESCRIPTION OF THE DRAWING FIGURES

DETAILED DESCRIPTION OF THE PREFERRED EMBODIMENT(S)

Figure 4A:
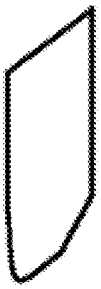
FIGS. 4A, 4B and 4C are depictions of typical cemented carbide inserts, including FIG. 4A (wood-cutting circular saw tip), FIG. 4B (oil and gas drilling insert) and FIG. 4C (masonry drill tip).
Figure 4B:
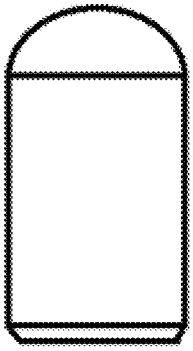
Figure 4C:
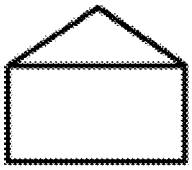
Figures 5A, 5B, 5C:
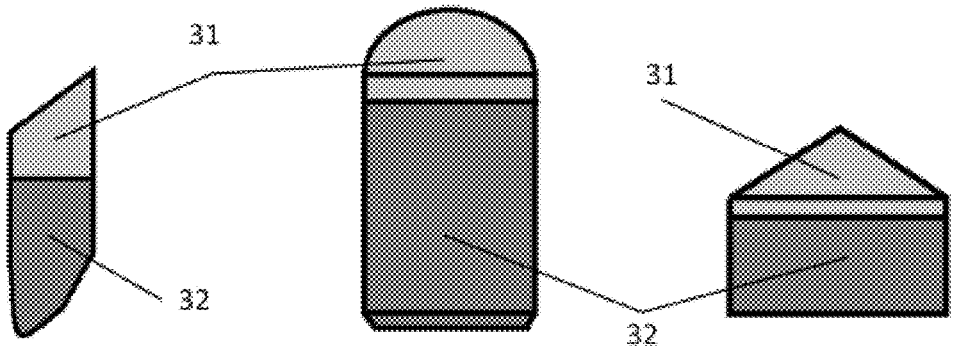
FIGS. 5A, 5B and 5C are depictions of typical cemented carbide inserts containing diamond particles joined with a regular cemented carbide substrate made in accordance with an embodiment of the invention described herein, including FIG. 5A (wood-cutting circular saw tip), FIG. 5B (oil and gas drilling insert) and FIG. 5C (masonry drill tip).
Figures 6A, 6B, 6C:
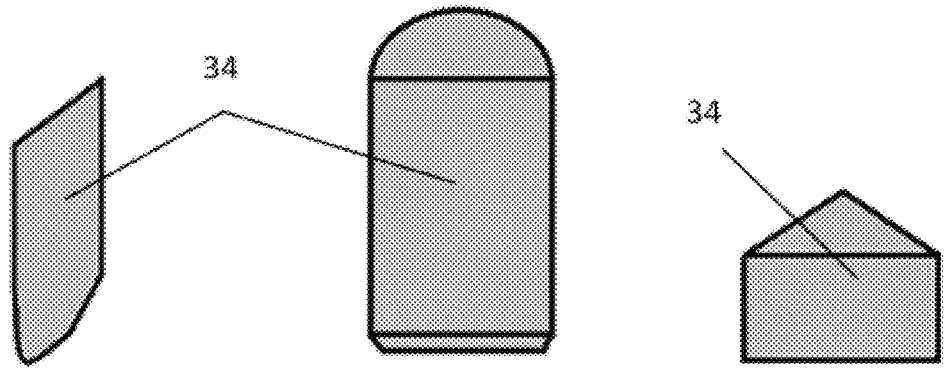
FIGS. 6A, 6B and 6C are depiction of a cemented carbide product containing diamond particles made in accordance with an embodiment of the invention described herein, including FIG. 6A (wood-cutting circular saw tip), FIG. 6B (oil and gas drilling insert) and FIG. 6C (masonry drill tip).

Referring now to FIGS. 4-6 and in accordance with one embodiment of the present invention, a novel method disclosed and claimed herein uses conventional techniques and equipment, plus surprisingly effective induction heating, to produce metal carbide articles containing diamond particles with surprisingly good impact resistance.

In one embodiment, particles of a metal carbide (MC) 13 such as tungsten carbide (WC) of a particular grain size and particles of a metallic binder (MB) 15 of a particular grain size and particles of crystalline diamond (D) 11 of a particular grain size (sometimes referred to as diamond grit) are blended together, then compacted to form a "green" MC-MB-D article. In some embodiments, the MC-MB-D mixture may include an organic binder such as paraffin or beeswax to aid in the green MC-MB-D article maintaining its shape and integrity.

The green MC-MB-D article, with or without organic binder, is then heated in a protective, non-oxidizing atmosphere in a conventional, production capacity, sintering furnace which is maintained in the range of 1000° C. to 1250° C., below the temperature at which the D particles would graphitize. The temperature may be maintained below the point where the D particles would react with or dissolve into the MB particles. If an organic binder is used, the green body is initially heated very slowly to allow the organic binder vapors to escape the green body without destroying the integrity of the green body.

Heating the green MC-MB-D body to where it is held at a temperature range of 1000° C. to 1250° C. as just stated for a period of time between one and 30 minutes results in a partially sintered, or under sintered, article wherein predominately solid state sintering has occurred in a manner understood in the metal carbide arts. While such a partially sintered, or under sintered, MC-MB-D article may not be as dense as desired for effective end-use drilling or cutting operations, it will be sturdy enough to be capable of being handled or processed in further manufacturing operations. If an organic binder is used to create/compact the MC-MB-D green part, persons skilled in the art appreciate that the initial portion of the heating cycle must be at a sufficiently low temperature for a sufficient time to permit the organic binder to escape from the MC-MB-D green part without destroying the integrity of the MC-MB-D article.

One of the attributes of a partially sintered, or under sintered, MC-MB-D article is that it is electrically conductive. The electrically conductive partially sintered MC-MB-D article may be rapidly heated by an induction heating device such as the model HFI 7.5 kW made by RDO Induction LLC. Other commercially available induction heating devices would likely be equally effective. Surprisingly, rapidly induction heating the under-sintered article to a held sintering temperature of between 1250° C. to 1450° C. for a period of time between only 5 and 20 minutes (so that graphitization of the D particles of the MC-MB-D article does not have time to occur) adequately completes the sintering thereof so that liquid phase sintering occurs in a manner that results in a fully sintered MC-MC-D article of desired compactness and density with diamond particles contained throughout the article. The term "sintering temperature" or "sintered at" is meant to note the peak temperature achieved during the sintering process, which in turn embraces the entire heating cycle, including initial heating, temperature gradient to arrive at the sintering temperature, as well as any cool down gradient, all of which may vary according to the composition being sintered and the desired end properties as understood by persons skilled in the art.

Figure 7:
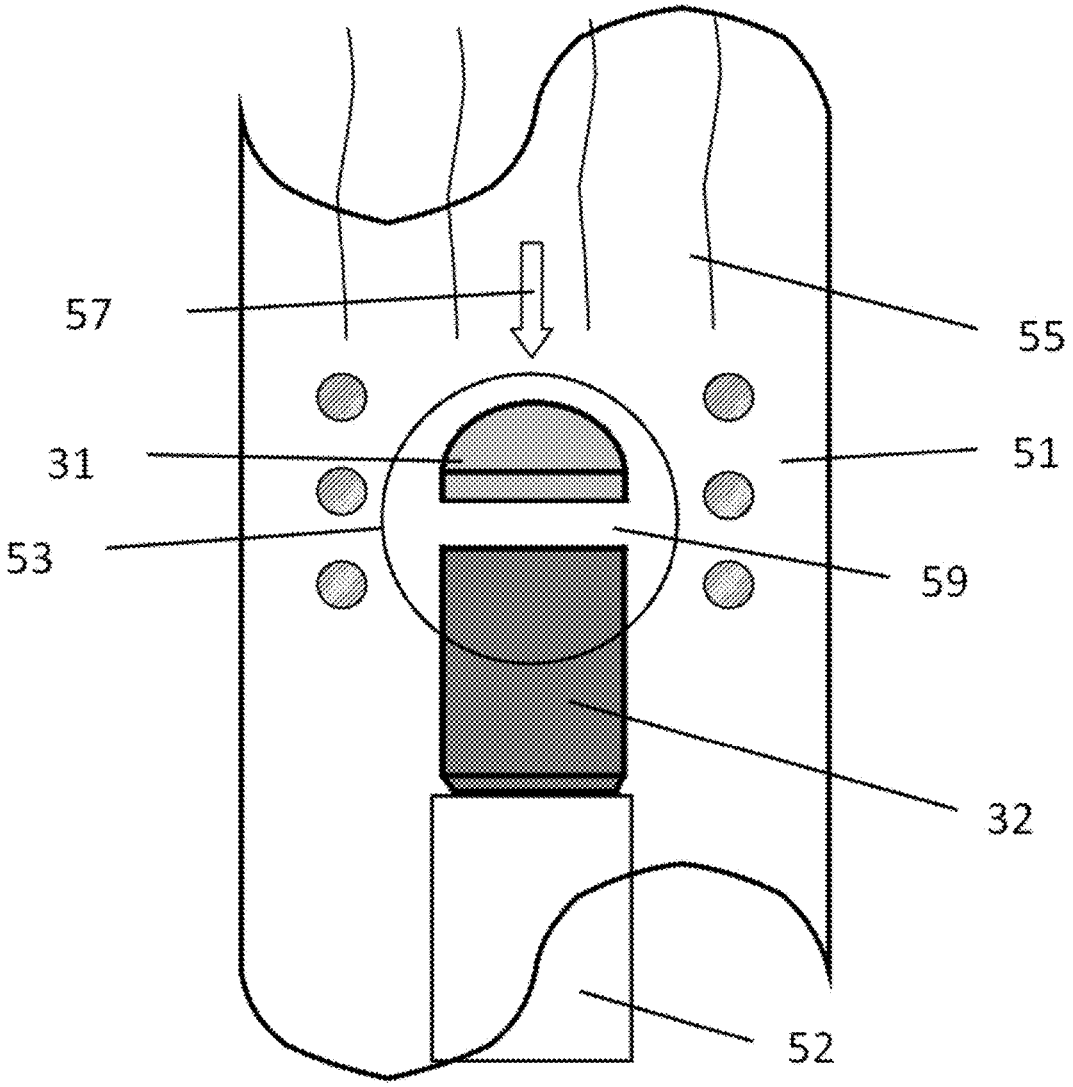
FIG. 7 is a depiction of the induction heating step of one embodiment of the method of the invention described herein.

Referring now to FIGS. 5 and 7, in one embodiment of practical usage, the MC-MB-D article is in a shape shown in FIG. 5B, with the MC-MB-D portion (or insert) 31 joined to a standard cemented carbide (CC) substrate 32, accomplished during the induction heating stage as described above, and depicted in FIG. 7. In one embodiment of the invention shown in FIG. 5, the MC-MB-D 31 part may be compacted separately from the CC part 32 forming the substrate to which the MC-MB-D part 31 is joined by induction heating as later described. The MC-MB-D part and the CC part are placed together and held in place by mechanical pressure and the mechanically-joined part is placed within the induction coil(s) in such a way that the induction currents flow predominately through the both MC-MB-D insert 31 and CC substrate 32 to sinter them together as shown in FIG. 7. In this embodiment because of their different thermal expansion properties, care must be taken to properly dimension the CC substrate 32 and the MC-MB-D tip or insert 31 so that the finished joined part is properly dimensioned.

Referring further to FIG. 5 and FIG. 7, the invention produces a MC-MB-D/CC joined part 31/32 by sintering by a preformed totally green part (i.e., where the MC-MB-D tip or insert 31 and the CC substrate 32 are physically pressed together and sintered by induction heating). In this embodiment, a mold cavity is partially filled with CC powder (i.e., MC powder and MB powder without D grit) and then the remainder of the cavity is filled with MC-MB-D powder and the combination of those two powders is pressed together, with or without organic binder, to form a green MC-MB-D/CC pressed part 31/32 made from totally green powder. The pressed MB-MC-D/CC part 31/32 is placed on a ceramic holding platform 52 and within the induction heating coil 51 to maximize the sintering temperature at the sintering zone 53. The pressed MC-MB-D/CC part 31/32 should not be subjected to mechanical pressure. The induction heating device is subjected to protective gas flow 55 under positive pressure, such as inert Argon gas or the like, to prevent oxidation during heating. Other non-oxidizing environments, such as a vacuum, could be utilized. The pressed MC-MB-D/CC part 31/32 is heated to a target sintering temperature produced by the induction heating coil to achieve sintering of both the MC-MB-D portion 31 and the CC substrate portion 32, and joinder of the MC-MB-D tip or insert 31 to the CC substrate 32 at joint 59. In this embodiment also because of their different thermal expansion properties, care must be taken to properly match the shrink factors of the CC substrate 32 and the MC-MB-D tip 31 so that the finished joined part is properly dimensioned.

Figure 8:
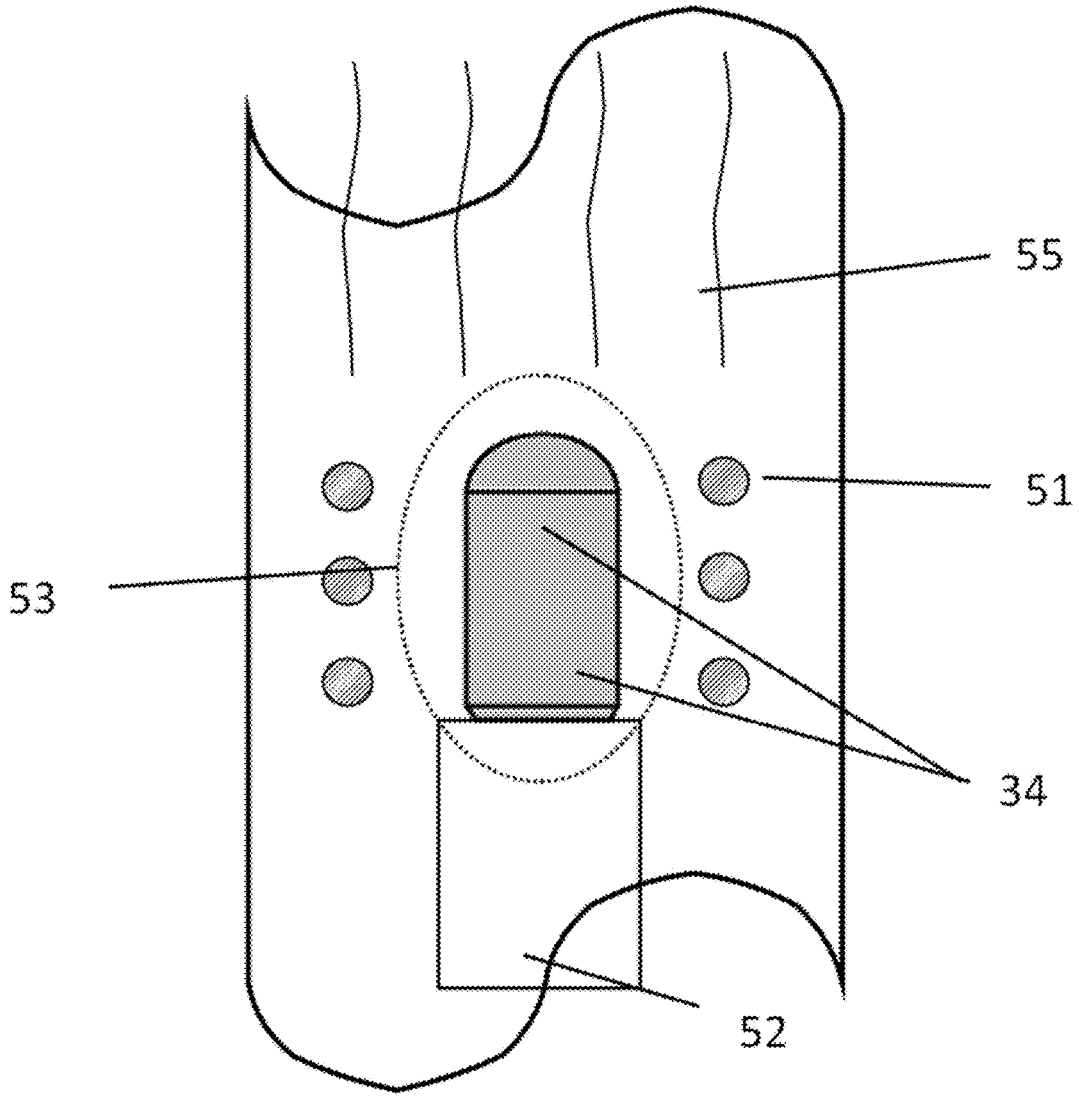
FIG. 8 is a depiction of the induction heating step of another embodiment of the method of the invention described herein.

Referring now to FIG. 6 and FIG. 8, a method of sintering by induction heating of a part comprised entirely of MC-MB-D 34 is shown. An under-sintered or partially sintered MC-MB-D part (produced in the manner set forth above) is placed within the induction heating coil 51 on a ceramic holding platform 52 to maximize the sintering temperature at the sintering zone 53. The induction heating device is subjected to protective gas flow 55 under positive pressure, such as inert Argon gas or the like, to prevent oxidation during heating. Other non-oxidizing atmospheres, such as a vacuum, could be utilized. The sintering temperature produced by the induction heating coil 51 for a proper time achieves sintering of the MC-MB-D part 34. In some instances, further enhanced compaction can be achieved by using high pressure gas flow, thus resulting in further reduced porosity.

The resulting induction heated fully-sintered MC-MB-D articles produced according to the above-stated process have surprisingly good impact resistance, equivalent to the impact resistance of regular MC-MB product, as measured by an internal fracture toughness "hammer" test. The impact resistance of MC-MB-D articles is much greater than the impact resistance of commercially available PCD/PDC products discussed above. The surprising impact resistance of the MC-MB-D articles made according to the process described herein is at least partially the result of the cemented MC-MB matrix.

In one embodiment of the disclosed invention, coated diamond particles may be used, to prevent the diamond particles of the MC-MB-D article from reacting with or dissolving into the MB matrix that develops during the under-sintering or final sintering phase. In this regard, IMB-D titanium-coated diamond particles available from American Super Abrasives of Shrewsbury, N.J. have demonstrated efficacy. And, as mentioned, use of intermetallic materials such as nickel aluminide ($Ni_3Al$) has been shown to avoid dissolution of the D particles into the MB matrix formed during sintering.

In another embodiment, a MC-MB brown part (with organic binder removed) has been successfully induction heated such that a sintered MC-MB-D is produced from a MC-MB-D green body solely by induction heating with an appropriate heating/sintering cycle, particularly where coated diamond particles are used (as describe above). Persons skilled in the metal carbide arts will appreciate that if a compacted MC-MB-D article to be induction heated includes an organic binder, the initial phase of the induction heating cycle must accommodate the burning off and consequent vapor escape of the organic binder without affecting the integrity of the article.

Example I

Commercially available tungsten carbide (WC) particles of 3.5 micron size were mixed with commercially available cobalt (Co) particles of 1.4 micron size and titanium coated IMB-D diamond particles of 90 micron size, available from American Super Abrasives as stated above, in a mixture of 70 volume percent WC particles, 10 volume percent Co particles and 20 volume percent coated diamond particles. An adequate amount of paraffin organic binder, approximately 3 weight percent, was added to enhance to compaction process. The MC-MB-D mixture was heated in a standard production sintering furnace under vacuum (any number of non-oxidizing atmospheres known to those skilled in the art would be acceptable substitutes for heating under vacuum) at a temperature of 1200° C. for 30 minutes, which resulted in a partially sintered, or under sintered, WC—Co-D article which was capable of being handled in further manufacturing operations without damage. After cooling, the partially sintered, or under sintered, WC—Co-D article was then placed in an induction heating furnace in the manner described above relating to FIG. 6 and rapidly heated to a sintering temperature of 1420° C. and held for only 5 minutes. Surprisingly, after cooling the resulting WC—Co-D product induction-heated/sintered for such a short time was fully sintered with diamond particles contained therein throughout the product. WC—Co-D product has been successfully made according to the above process to produce a WC—Co-D insert of both ½ inch and ⅝ inch inserts in the shape generally shown in FIG. 3B.

Figure 1:
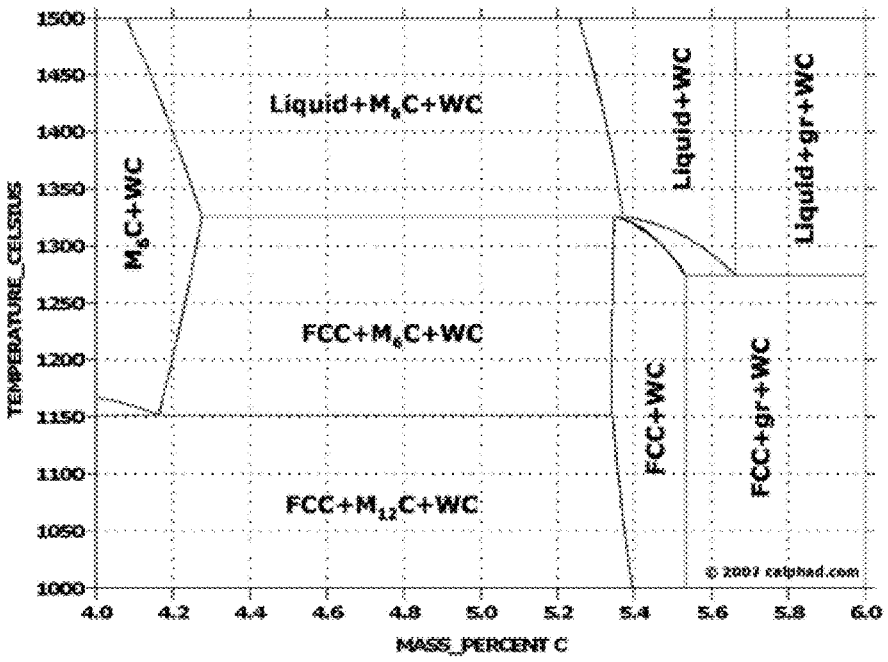
FIG. 1 is a phase diagram of WC—Co—C.
Figure 2:
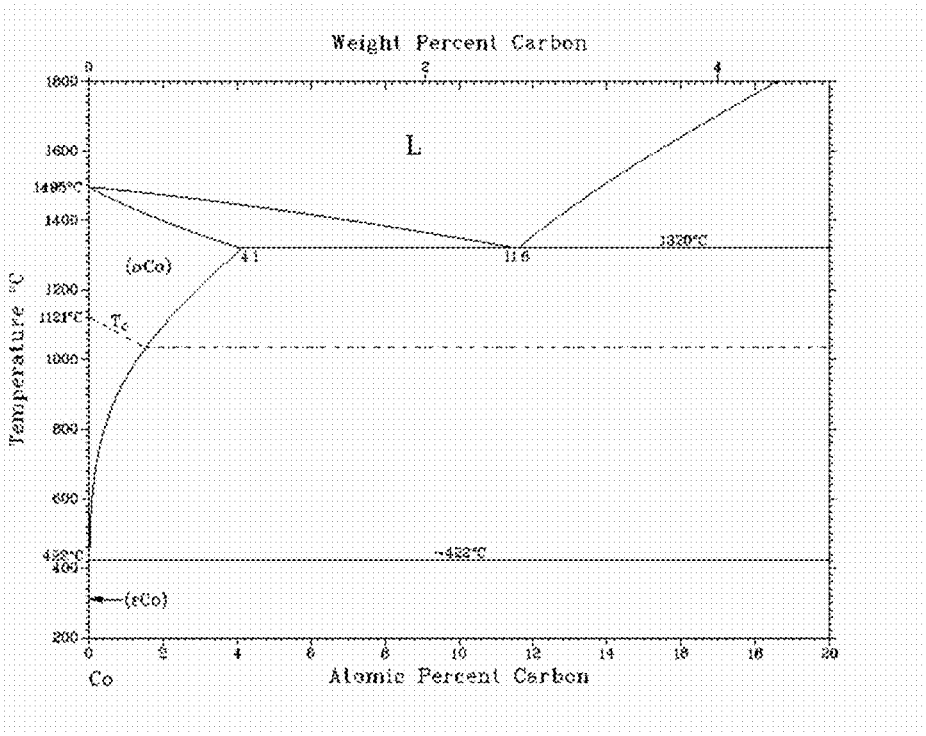
FIG. 2 is a phase diagram of Co—C.
Figure 3:
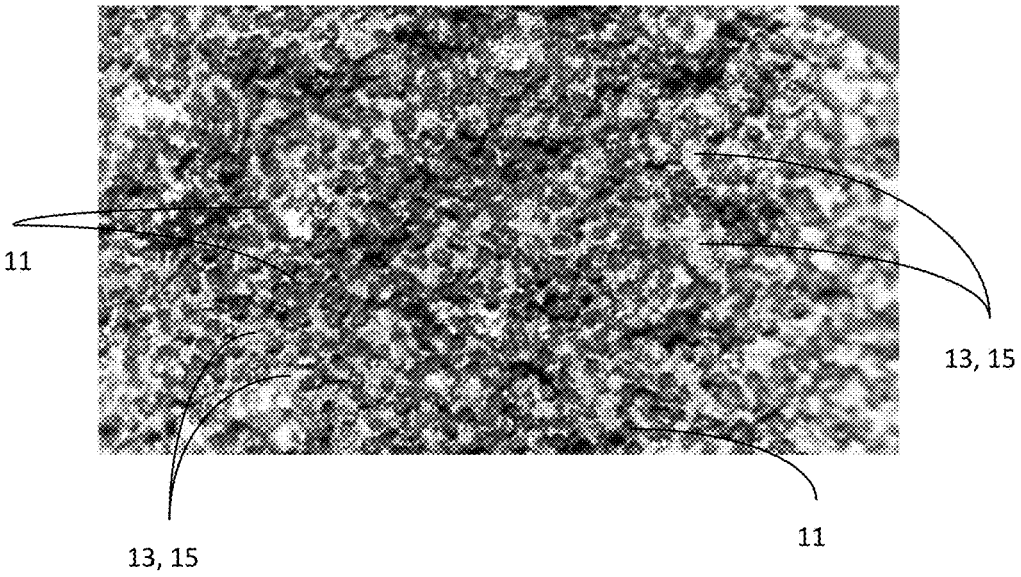
FIG. 3 is a microphotograph taken with a microstereoscope at 30X of a fractured article made in accordance with one embodiment of the invention described herein, showing the diamond particles contained throughout the article.

A microphotograph of a fractured surface of the resulting fully sintered WC—Co-D product taken with a stereoscope is shown in FIG. 3, with reference 11 showing the D particles which are still in rounded form, references 13 and 15 showing a cemented WC—Co matrix surrounding the D particles 11. The difference in shade between WC—Co matrix 13 and 15 is due to light reflection differences in the stereoscopic photograph.

Figure 9:
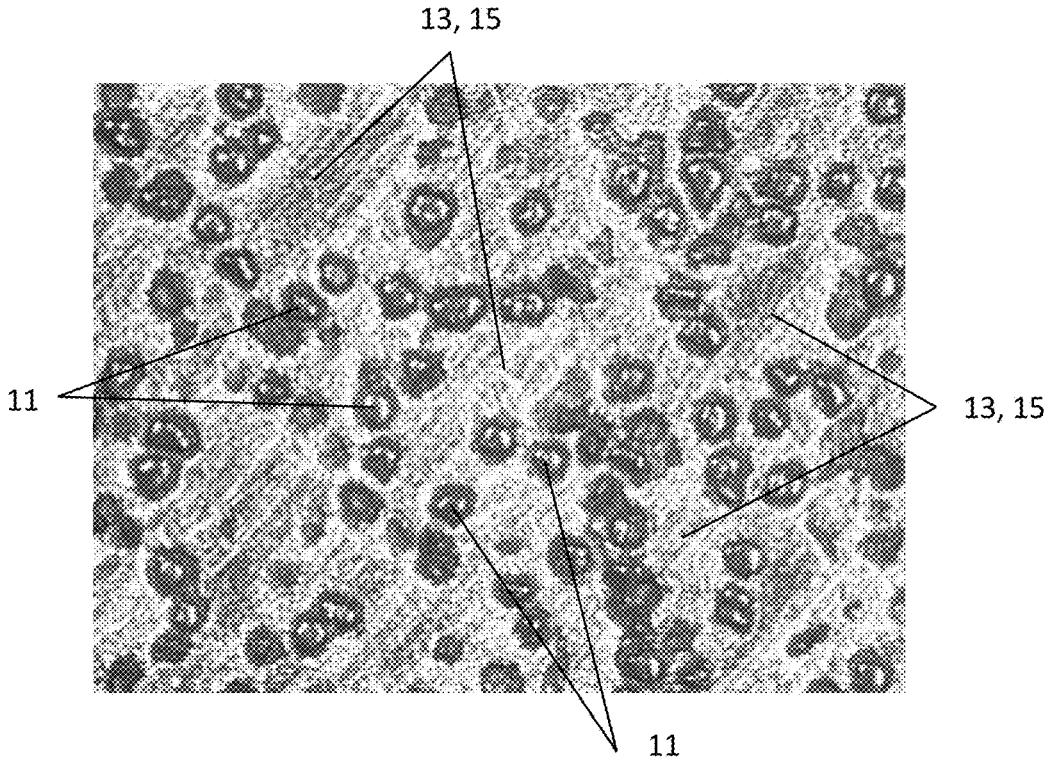
FIG. 9 is a microphotograph taken with a microstereoscope at 30X of an attempted polished section of an article made in accordance with one embodiment of the invention described herein, showing the diamond particles contained throughout the article.

Referring to FIG. 9, an attempt was made to create a polished section of the WC—Co-D product made as described above, but a fully polished section could not be created because of the presence of the D particles throughout the product. Nevertheless, the microphotograph taken with a stereoscope shows the presence of D particles 11 throughout the product, surrounded by and contained within a "matrix" of WC—Co 13, 15 which is shown as "streaks" resulting from the diamond-on-diamond contact during the attempt to create the polished section.

The WC—Co-D insert product made as described above exhibited good microstructure with well distributed diamond particles, without significant porosity. In addition, shop tests in drilling the WC—Co-D product in a diamond grinding wheel (resin-bonded diamond) exhibited a removal rate (volume of removed material per unit of time) about 196 times higher than regular WC—Co product, as well as about a 35% longer life. And, as mentioned above, the WC—Co-D insert showed surprisingly high impact resistance for a product containing diamond: the impact resistance was at least equivalent to the impact resistance of a similarly constituted WC—Co product.

Those skilled in the metal carbide arts appreciate that a wide range of mixtures, depending on the end-use of the product, can be used to create an acceptable cemented metal carbide. Tungsten carbide (WC) or other metal carbide (MC) can be from 30 to 80 volume percent of the total mixture; cobalt (Co) or other metallic binder (MB) can be from 5 to 30 volume percent of the total mixture; and diamond particles or grit (D) can be from 5 to 50 volume percent of the total mixture. The exact mixture would be selected by a person skilled in the art based upon the end use of the product. In situations where desired, the organic binder is between one and five weight percent of the total mixture.

In addition, those skilled in the metal carbide arts know that WC (or other MC) is available in or can be processed to a wide range of grain sizes, from 0.5 to 20 microns; Co (or other MB) from 0.5 to 5 microns; and D particles or grit (coated or uncoated) from 10 to 200 microns. The exact grain size of the constituents of the mixture would be selected by a person skilled in the art based upon the end use of the product.

Example II

A regular WC—Co green part was heated to remove the organic binder to produce a "brown" part which was successfully induction-heated to a sintering temperature of 1420° C. and held for 5 minutes to create a sintered WC—Co article. If a green WC—Co-D part (or any other MC-MB-D part) containing an organic binder is to be induction heated, care must be taken to initially induction heat the green WC—Co-D (or MC-MB-D) part in such a way as to allow the organic vapors to escape without damaging the integrity of the WC—Co-D (or MC-MB-D) part during the remainder of the sintering process.

Example III

Uncoated diamond grit of 20 micron particle size was placed in the concave upper part of a regular WC—Co holder of cylindrical shape. The carbide holder was induction heated to a temperature of 1420° C. and held for a time of 10 minutes. The diamond particles not in contact with the carbide holder remained intact, did not transform into graphite and did not show any kind of reaction. The bottom layer in direct contact with the cemented carbide holder was dissolved by the Co binder and precipitated as free carbon after cooling. This shows that uncoated diamond grit could be used in a WC—Co-D part without graphitization.

While the present invention has been shown and described herein in what are considered to be the preferred embodiments thereof, illustrating the results and advantages over the prior art obtained through the present invention, the invention is not limited to those specific embodiments. Thus, the forms of the invention shown and described herein are to be taken as illustrative only and other embodiments may be selected without departing from the scope of the disclosed invention, as set forth in the claims appended hereto.

I claim:

1. A method for making a sintered metal carbide (MC) article containing diamond particles throughout said article, comprising the steps of:

a. combining metal carbide (MC) particles of a selected grain size, metallic binder (MB) particles of a selected grain size, diamond particles (D) of a selected grain size and an organic binder (OB) to create a MC-MB- D-OB mixture having diamond particles distributed throughout said MC-MB-D-OB mixture;

b. compacting said MC-MB-D-OB mixture to a produce a free standing green MC-MB-D-OB article of a defined shape;

c. heating said free standing green MC-MB-D-OB article in a non-oxidizing environment to remove the OB in a manner that does not affect the integrity and shape of the article being heated in order to produce a free standing partially sintered and conductive MC-MB-D article of defined shape; and d. induction heating said free standing partially sintered and conductive MC-MB-D article in a non-oxidizing environment to a sintering temperature range of from about 1350° C. to about 1500° C. for about 5 to about 20 minutes to produce a sintered MC-MB-D article of defined shape.

2. The method of claim 1, wherein said organic binder is selected from a group consisting of: paraffin, bees wax, and polymeric resins.

3. The method of claim 1, wherein said heating of step c. is to a temperature above 600° C. but not to exceed a temperature at which liquid phase sintering occurs for the MC-MB-D article being heated.

4. The method of claim 3, wherein the metal component of said MC is tungsten carbide (WC), the metal component of said MB is cobalt (Co), and said heating of step c. is to a temperature above about 600° C. but not to exceed about 1250° C.

5. The method of claim 3, wherein the diamond particles are distributed substantially uniformly throughout said sintered MC-MB-D article.

6. The method of claim 5, wherein said diamond (D) particles are coated with a material to prevent said diamond (D) particles from interacting with said metallic binder (MB) particles when said mixture is subjected to heat.

7. The method of claim 6, wherein said diamond (D) particles are coated with a carbide-forming metal selected from a group consisting of: titanium (Ti), chromium (Cr), vanadium (V), tungsten (W), niobium (Nb), and tantalum (Ta).

8. The method of claim 7, wherein said carbide-forming metal is titanium (Ti).

9. The method of claim 8, wherein a ratio of a size of said diamond (D) particles to a size of said metal carbide (MC) particles does not exceed about 100:1.

10. The method of claim 1, wherein said MC particles comprise about 30% to about 80% by volume, said MB particles comprise about 5% to about 30% by volume, said D particles comprise about 5% to about 50% by volume, and the OB comprises about 1% to about 10% by volume of the MC-MB-D-OB mixture.

11. A method for making a sintered tungsten carbide (WC) article containing diamond particles throughout said article, comprising the steps of:

a. combining 30-80% by volume tungsten carbide (WC) particles of 0.5-20 micron grain size, 5-30% by volume metallic binder (MB) particles of 0.5-5.0 micron grain size, 5-50% by volume titanium-coated Diamond particles (TiD) of 10-200 micron grain size and 1.5-5% by weight organic binder (OB) to create a WC-MB-TiD OB mixture having said titanium coated diamond (TiD) particles substantially uniformly distributed throughout said WC-MB-TiD-OB mixture;

b. compacting said WC-MB-TiD-OB mixture to a produce a free standing green WC-MB-TiD-OB article of a defined shape;

c. heating said free standing green WC-MB-TiD-OB defined shape article in a non-oxidizing environment to a temperature in the range of from about 1000° C. to about 1250° C. to remove said OB in a manner such that escaping OB vapor does not affect the integrity and defined shape of the article being heated to produce a free standing partially sintered and conductive WC-MB-TiD article of defined shape; and d. induction heating said free standing partially sintered and conductive WC-MB-TiD in a non-oxidizing environment in the range of about 1350° C. to about 1500° C. for about 5 to about 20 minutes to produce a sintered WC-MB-TiD article of defined shape.

12. The method of claim 11, wherein said organic binder (OB) is selected from the group of paraffin, bees wax and polymeric resins.

13. The method of claim 11, wherein said metallic binder is selected from the group of cobalt (Co), nickel (Ni) and iron (Fe).

14. A method for making a joined sintered metal carbide article containing diamond particles throughout said article, comprising the steps of:

a. producing a cemented carbide (CC) substrate;

b. separately producing a partially sintered metal carbide (MC)—metal binder (MB)-Diamond (D) insert of defined shape and dimensions by i. combining metal carbide (MC) particles of a selected grain size, metallic binder (MB) particles of a selected grain size and Diamond particles (D) of a selected grain size and an organic binder (OB) to create a MC-MB-D-OB mixture having Diamond particles substantially uniformly distributed throughout said MC-MB-D-OB mixture;

ii. compacting said MC-MB-D-OB mixture to produce a free standing green MC-MB-D insert of defined shape and dimensions;

iii. heating said free standing green MC-MB-D-OB insert of defined shape and dimensions in a non-oxidizing environment in a manner whereby the integrity and defined shape of said MC-MB-D-OB insert is maintained to produce a free standing partially sintered and conductive MC-MB-D insert of defined shape and dimensions;

iv. cooling said free standing partially sintered and conductive MC-MB-D insert;

c. placing said free standing partially sintered and conductive MC-MB-D insert on top of said CC substrate to produce a free standing mechanically-joined MC-MB-D/CC article of defined shape and dimensions; and d. induction heating said free standing mechanically-joined MC-MB-D/CC article to a sintering temperature range of from about 1350° C. to about 1500° C. for about 5 to about 20 minutes while maintaining said free standing mechanically-joined MC-MB-D insert and said CC substrate under mechanical pressure in a non-oxidizing environment to produce a sintered joined MC-MB-D/CC article of defined shape and dimensions.

* * * * *